US005673020A

United States Patent [19]

Okayama

[11] Patent Number: 5,673,020

[45] Date of Patent: Sep. 30, 1997

[54] EARLY STAGE FIRE DETECTING APPARATUS

[75] Inventor: Yoshiaki Okayama, Tokyo, Japan

[73] Assignee: Nohmi Bosai Ltd., Tokyo, Japan

[21] Appl. No.: 412,272

[22] Filed: Mar. 28, 1995

[30] Foreign Application Priority Data

Mar. 30, 1994 [JP] Japan ..... 6-061652

[51] Int. Cl.[6] ..... G08B 29/00

[52] U.S. Cl. ..... 340/511; 340/514; 340/505; 340/588; 340/589

[58] Field of Search ..... 340/511, 512, 340/506, 505, 514, 587, 588, 510, 589

[56] References Cited

U.S. PATENT DOCUMENTS

| | | | |
|---|---|---|---|
| 4,749,986 | 6/1988 | Otani et al. | 340/511 |
| 4,884,222 | 11/1989 | Nagashima et al. | 340/514 |
| 5,168,262 | 12/1992 | Okayama | 340/511 |
| 5,281,951 | 1/1994 | Okayama | 340/511 |

FOREIGN PATENT DOCUMENTS

| | | |
|---|---|---|
| 0396767 | 11/1990 | European Pat. Off. . |
| 4127004 | 2/1993 | Germany . |
| 1558471 | 1/1990 | United Kingdom . |

OTHER PUBLICATIONS

Patent Abstracts of Japan, vol. 17, No. 560 (P–1627) 8 Oct. 1993.

Patent Abstracts of Japan, vol. 17, No. 242 (P–1535) 14 May 1993.

Patent Abstracts of Japan, vol. 17, No. 280 (P–1547) 28 May 1993.

Patent Abstracts of Japan, vol. 16, No. 109 (P–1326) 17 Mar. 1992.

*Primary Examiner*—Donnie L. Crosland
*Attorney, Agent, or Firm*—Wenderoth, Lind & Ponack

[57] ABSTRACT

An early stage fire detecting apparatus is arranged such that a fire state is discriminated based on a fire probability output from a signal processing network. The fire probability being prepared in such a manner that outputs from a high sensitivity smoke sensor SS and a smell sensor NS, from which responses can be obtained at the early stage of a fire, are subjected to signal processing. Fire information composed of a value at a given moment of smoke and a difference indicating the increase or decrease of the value at a given moment of the smoke and a value at a given moment of smell and a difference indicating the increase or decrease of the value at a given moment of the smell are input to the signal processing network. The signal processing network outputs the above fire probability based on a table (RAM12) defining a fire probability to be obtained from the above fire information and weighting values (RAM13). With this arrangement, an early stage fire can be detected by explicitly excluding non-fire factors such as tobacco, steam vapor, the smell of coffee, and the like.

12 Claims, 8 Drawing Sheets

FIG. 2

DEFINITION TABLE (RAM12)

| PATTERN | A | B | C | D | E | F |
|---|---|---|---|---|---|---|
| VALUE AT GIVEN TIME OF SMELL IN1 | 0.03 | 1.00 | 0.02 | 0.26 | 0.63 | 0.87 |
| DIFFERENCE OF SMELL IN2 | 0.01 | 1.00 | 0.05 | 0.04 | 0.14 | 0.54 |
| VALUE AT GIVEN TIME OF SMOKE IN3 | 0.07 | 0.06 | 0.15 | 0.24 | 0.46 | 0.95 |
| DIFFERENCE OF SMOKE IN4 | 0.01 | 0.00 | 0.09 | 0.07 | 0.20 | 0.93 |
| FIRE PROBABILITY T | 0.00 | 0.20 | 0.10 | 0.05 | 0.90 | 0.95 |

FIG. 8

DEFINITION TABLE (RAM12)

| PATTERN | A | B | C | D | E | F |
|---|---|---|---|---|---|---|
| VALUE AT GIVEN TIME OF SMELL IN1 | 0.03 | 1.00 | 0.02 | 0.26 | 0.63 | 0.87 |
| DIFFERENCE OF SMELL IN2 | 0.01 | 1.00 | 0.05 | 0.04 | 0.14 | 0.54 |
| VALUE AT GIVEN TIME OF SMOKE IN3 | 0.07 | 0.06 | 0.15 | 0.24 | 0.46 | 0.95 |
| DIFFERENCE OF SMOKE IN4 | 0.01 | 0.00 | 0.09 | 0.07 | 0.20 | 0.93 |
| FIRE PROBABILITY OT1 | 0.005 | 0.196 | 0.119 | 0.034 | 0.853 | 0.996 |

FIG. 9

| wij | | wij | | wij | | wij | | vij | |
|---|---|---|---|---|---|---|---|---|---|
| w11 | 2.08 | w21 | 0.54 | w31 | 1.96 | w41 | -14.77 | v11 | -3.83 |
| w12 | -7.15 | w22 | -5.25 | w32 | 0.46 | w42 | 2.32 | v12 | -5.53 |
| w13 | 4.47 | w23 | -2.26 | w33 | 1.92 | w43 | 1.37 | v13 | 6.46 |
| w14 | -2.98 | w24 | 0.665 | w34 | -1.40 | w44 | 9.79 | v14 | -8.93 |

EARLY STAGE FIRE DETECTING APPARATUS

BACKGROUND OF THE INVENTION

1. Field of the Invention

The present invention relates to an early stage fire detecting apparatus for detecting physical values based on a fire phenomenon and monitoring a fire from the data.

2. Description of the Related Art

Methods are proposed to detect the occurrence of a fire based on outputs from fire detectors detecting heat, smoke, flame, gas and the like caused by a fire phenomenon to determine and differential values (inclinations per unit time), integral values (or cumulative values), differences, amounts of transition in time of continuous time zones and the like of the outputs.

Further, Japanese Patent Laid-Open Nos. 2-105299 and 2-128297 titled "Fire alarm apparatus" and filed by the present applicant, disclose apparatuses each arranged such that a plurality of inputs are applied to signal processing means having a network structure called a neural network, arithmetic operations are carried out based on various types of fire information input to the network structure and a desired result as to a fire probability, a degree of danger, and the like is determined.

A fire probability or a value for discriminating a fire corresponding to the plurality of types of fire information is generally obtained in such a manner that patterns of input information and definition tables of fire probabilities or values for discriminating a fire corresponding to respective patterns are prepared and when input information is applied, a fire probability or a value for discriminating a fire corresponding to the input information is determined from the result of a signal processing of the network structure effected based on the pattern in the table which coincides with the input information.

Recently, computer rooms and the like are constructed as air-tight structures with restricted communication with the outside to maintain a clean atmosphere. Consequently, it is contemplated that if a fire occurs once, a refuge operation and a fire extinguishing operation are greatly suppressed, thus instant action must be taken in the usual monitoring operation of a fire in such a place.

SUMMARY OF THE INVENTION

Taking the above into consideration, an object of the present invention is to provide a fire detecting apparatus capable of detecting an early stage fire sooner than a usual fire detecting apparatus can detect a fire.

To detect an early stage fire, the present invention comprises a high sensitivity smoke sensor for detecting a concentration of smoke, a smell sensor for detecting smell, input means for subjecting output values from the high sensitivity smoke sensor and the smell sensor to signal processing and obtaining four types of input data composed of a value at a given moment and an amount of change, in time, of the concentration of smoke and a value at a given moment and an amount of change, in time, of the smell, a signal processing network for calculating a fire probability based on the values of the four types of the input data obtained by the input means, and fire discriminating means for discriminating a fire state based on the fire probability calculated by the signal processing network.

Because a fire is detected using the respective sensors from which responses can be obtained at the early stage of a fire through a signal processing network (neural network), an early stage fire can be detected by explicitly excluding non-fire factors such as tobacco and the like. Since the accuracy of the signal processing network can be improved by learning, the unacceptable portion of an original definition table can be easily corrected.

BRIEF DESCRIPTION OF THE DRAWINGS

FIG. 2 is a view showing a definition table used in the embodiment;

FIG. 8 is a table showing fire probabilities obtained by a network structure of the embodiment; and FIG. 9 is a table showing respective weighting values used to obtain the result shown in FIG. 8.

DESCRIPTION OF PREFERRED EMBODIMENTS

An embodiment of the present invention will be described below.

Figure 1:
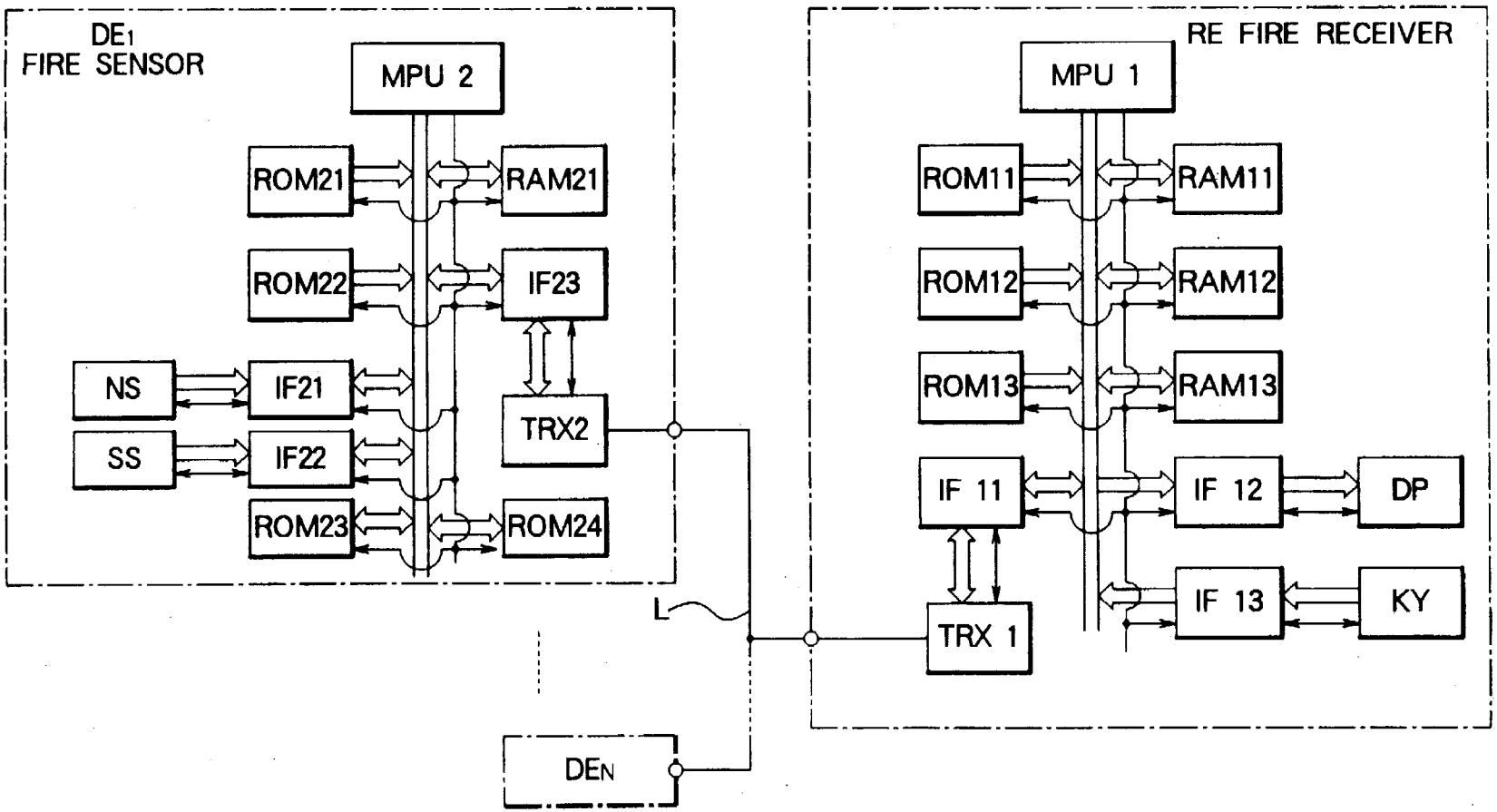
FIG. 1 is a block diagram showing an early stage fire detecting apparatus according to an embodiment of the present invention.

FIG. 1 is a block circuit diagram when the present invention is applied to so-called analog type fire alarm systems arranged such that the detected levels of physical amounts based on a fire phenomenon detected by respective fire detectors are supplied to receiving means such as a fire receiver, a transmitter and the like. The receiving means makes a discrimination of a fire based on the detected levels collected. Furthermore, the present invention is also applicable to an on/off type fire alarm system in which a discrimination of a fire is made by respective fire detectors and only the result of the discrimination is supplied to the receiving means.

In FIG. 1, RE denotes a fire receiver and $DE_1$–$DE_N$ denotes N sets of fire detectors connected to the fire receiver RE through a transmission line L, for example, a pair of signal lines also serving as a power source. Only the internal circuit of one of the fire detectors is shown in detail in FIG.

In the fire receiver RE, MPU1 denotes a microprocessor, ROM11 denotes a memory region for storing programs relating to the operation of the fire receiver RE to be described later, ROM12 denotes a memory region for storing various constant value tables such as fire discrimination standard levels with respect to the fire detectors $DE_1$–$DE_N$, ROM13 denotes a memory region for storing a terminal address table in which the addresses of the respective fire detectors are stored, RAM11 denotes a memory region for a job, RAM12 denotes a memory region for storing a definition table to be described later which is applied to the respective fire detectors, RAM13 denotes a memory region for storing weighting values for signal lines, to be described later, which are applied to the respective fire detectors, TRX1 denotes a signal transmitting/receiving unit composed of a serial/parallel converter, parallel/serial converter and the like, DP denotes a display unit such as a CRT, KY denotes a key unit for inputting data and the like, and IF11, IF12 and IF13 denote interfaces.

Further, in the fire detector $DE_1$, MPU2 denotes a microprocessor, ROM21 denotes a memory region for storing programs relating to the operation of the fire detector $DE_1$ to be described later, ROM22 denotes a memory region for storing a self-address, ROM 23 denotes a memory region for storing data for outputting the standards of the detected levels of scorched smell to be described later, ROM24 denotes a memory region storing data for outputting the standards of the detected levels of smoke to be described later, RAM21 denotes a memory region for a job, TRX2 denotes a signal transmitting/receiving unit composed of a serial/parallel converter, parallel/serial converter and the like, NS denotes a smell sensor for detecting scorching smell resulting from a fire by, for example, a stannic oxide thin film element, SS denotes a smoke sensor for detecting smoke resulting from a fire with a high sensitivity by a scattered light using a strong light emitting source, for example, a xenon lamp, and IF21, IF22 and IF23 denote interfaces.

Figure 3:
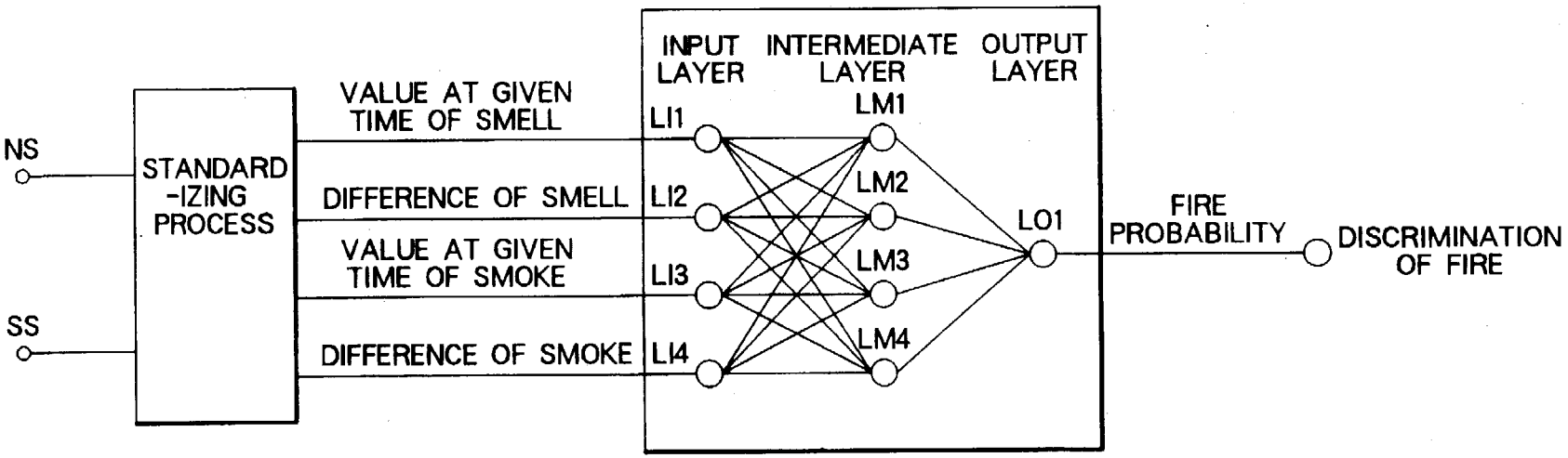
FIG. 3 is a view showing a concept of a signal processing network used in the embodiment.

The present invention intends to securely and promptly obtain a fire probability based on fire information from the smell sensor NS and the high sensitivity smoke sensor SS detecting physical amounts resulting from an early stage fire phenomenon using the arrangement shown in the block circuit diagram of FIG. 1. That is, the present invention is arranged such that a value at a given moment and a difference as an amount of transition in time of smell as fire information from the smell sensor NS and a value at a given moment and a difference of smoke as the fire information from the smoke sensor SS are input to obtain a fire probability as an output, and FIG. 2 and FIG. 3 show the operation of the present invention.

FIG. 2 is a view of a definition table showing fire probabilities corresponding to patterns A–F composed of six types of combinations obtained by combining four types of fire information, i.e., a value at a given moment and a difference of smell and a value at a given moment and a difference of smoke and these fire probabilities are obtained by experiments, field tests and the like. Such a table can be accurately prepared by experiments and the like taking the characteristics of fire detectors and locations where the fire detectors are installed into consideration. Although it is preferable to prepare the table for many patterns (i.e. not just the six patterns), it is practically impossible to prepare such a table for all the patterns. According to the operation of the present invention to be described below, however, it is possible to determine the accurate fire probabilities for all the patterns based on the four types of fire information.

In FIG. 2, the four types of fire information are shown in the uppermost rows and fire probabilities T corresponding to the fire information in the uppermost rows are shown in the lowermost row by 0 to 1. The respective values of the fire information in the uppermost rows are shown by being converted into standardized values of 0 to 1 and an example of standardization is shown in the row. It is assumed that a value 1 of smell at a given moment corresponds to an output from the smell sensor NS when the sensor detects that a copy paper is baked and a scorching smell is saturated in the sensor, whereas a value 0 of smell at a given moment corresponds to an output from the smell sensor NS in clean air. It is assumed that a difference 1 of smell corresponds to the case that when a level of smell detected by the smell sensor NS at a given moment is represented by X and a level of smell detected at a predetermined moment before the given moment is represented by Y, a ratio of change of Y to X is increased by 10%, whereas a difference 0 of smell corresponds to the case that the ratio of change of Y to X is decreased by 10%. Further, it is assumed that a value 1 of smoke at a given moment corresponds to an output from the smoke sensor SS in saturation and the value corresponds to about 1%/m of a concentration of smoke when converted into a light obscuration rate, whereas a value 0 of smoke at a given moment is assumed to corresponds to 0%/m of the concentration of smoke. It is assumed that a difference 1 of smoke corresponds to the case that a ratio of change of a detected level Y of smoke detected at a predetermined moment before a given moment to a detected level X of smoke detected at the given moment is increased by 10% similar to the case of smell, whereas a difference 0 of smoke corresponds to the case that the ratio of change of Y to X is decreased by 10%. Further, to describe the patterns of the definition table, the pattern A corresponds to the case of a usual state without any person, the pattern B corresponds to the case where the smell of coffee and the like exists, the pattern C corresponds to the case where tobacco smoke exists, the pattern D corresponds to the case where a fire is detected apart from a fire point, and the pattern E corresponds to the case where a fire is detected just in the location.

A fire discrimination algorithm will be described on the assumption of a network structure shown in FIG. 3 to explain the operation of the present invention. An object of the network structure is to apply a value at a given moment and a difference of smell and a value at a given moment and a difference of smoke each converted into 0 to 1 to input layers LI1, LI2, LI3 and LI4 and obtain accurate fire probabilities represented by 0 to 1 likewise from an output layer LO1. It is assumed that the network structure exists in the fire receiver RE corresponding to each fire detector DE.

In the network structure shown in FIG. 3, when the four input layers LI1, LI2, LI3 and LI4 on the left side are referred to as an input layer LI, the single output layer LO1 on the right side is referred to as an output layer LO and four intermediate layers LM1, LM2, LM3 and LM4 are referred to as an intermediate layer LM, the respective intermediate layers LM1–LM4 receive signals from the respective input layers LI1–LI4 as well as output a signal to the output layer LO1. It is assumed that: signals are exclusively directed from the input layers to the output layer; signals are not directed inversely; no signal is coupled in the same layer and further there is no direct connection of signals from the input layers to the output layer. Therefore, there are 16 signal lines from the input layers to the intermediate layers and 4 signal lines from the intermediate layers to the output layer as shown in FIG. 3.

The weighting values, as the degrees of coupling of these signal lines shown in FIG. 3, are changed depending upon values to be output from the output layer in accordance with signals input from the respective input layers, and a larger weighting value enables a signal to pass through the signal line better. The weighting values of the signal lines between the input layers and the intermediate layers and between the intermediate layers and the output layer are initially adjusted in accordance with the relationship between inputs and outputs and stored in the region of each fire detector in the memory region RAM13 of FIG. 1. An early stage fire is detected by the thus stored weighting values.

More specifically, the four values, i.e., the value at a given moment and the difference of smell and the value at a given moment and the difference of smoke shown in the upper rows of the definition table of FIG. 2 are applied to the input layers LI1–LI4 of FIG. 3, respectively as inputs by a network creating program to be described later, a value output from the output layer L01 based on the inputs is compared with the value of the fire probability T as a teacher's signal or learning data shown in the lowermost row in FIG. 2 and the weighting values of the respective signal lines are changed to minimize error. In this manner, it is possible to teach values which are very near to the entire function of the definition table of FIG. 2 which are represented by only the six types of patterns.

In the above embodiment, when it is assumed that a weighting value between an input layer LIi and an intermediate layer LMj is represented by wij, and a weighting value between an intermediate layer LMj and an output layer LOk is represented by vjk (i=1 to I, j=1 to J, k=1 to K, and in this case i=1 to 4, j=1 to 4 and k=1) and the weighting values wij and vjk are a positive value, 0 or a negative value, respectively and an input value in the input layer LIi is represented by INi, the total sum NET1(j) of the inputs to the intermediate layer LMj is represented by the following equation 1.

$$NET1(j) = \sum_{i=1}^{I} (INi \cdot wij) \tag{1}$$

When the value NET1(j) is converted into a value of 0 to 1 by, for example, a sigmoid function and represented by IMj, the following equation 2 is obtained.

$$IMj = \frac{1}{1 + \mathrm{EXP}[-NET1(j) \cdot \gamma 1]} \tag{2}$$

In the same way, the sum NET2 (k) of the inputs to the output layer LOk is represented by the following equation 3.

$$NET2(k) = \sum_{j-1}^{J} (IMj \cdot vjk) \tag{3}$$

When the value NET2(k) is converted into a value of 0 to 1 by a sigmoid function likewise and represented by OTk, the following equation 4 is obtained.

$$OTk = \frac{1}{1 + \mathrm{EXP}[-NET2(k) \cdot \gamma 2]} \tag{4}$$

As described above, the relationship between the input values IN1 to IN4 and the output value OT1 in the network structure shown in FIG. 3 is represented by the equations 1 to 4 using the weighting values, wherein γ1 and γ2 are adjusting coefficients of a sigmoid curve and they are suitably selected as γ1=1.0 and γ2=1.2 in this embodiment.

When one of the combined patterns IN1 to IN4 shown as the six types of the patterns in the definition table stored in the memory region RAM12 is applied to the input layers shown in FIG. 3 in the network creating program, the actual output OT1 calculated by the aforesaid equations 1 to 4 and output from the output layer is compared with the teacher's output T shown in the lowermost row of FIG. 2 and the sum of errors Em (m=1 to M and in this case m=6) in the output layer at that time is represented by the following equation 5.

$$Em = \sum_{k=1}^{k} \frac{1}{2} (OTk - Tk)^2 \tag{5}$$

wherein, OTk is a value determined by the above equation 4. A value E obtained by summing the sum of errors Em with respect to all the 6 types of the patterns A to F in FIG. 2 is represented by the following equation 6.

$$E = \sum_{m=1}^{M} (Em) \tag{6}$$

Finally, the weighting value of each of the signal lines is adjusted to minimize the value E in the equation 6. Then, the weighting values stored in each fire detector region in the memory region RAM13 are replaced with the thus adjusted new weighting values and used to monitor an early stage fire. The adjustment of the weighting values of the signal lines as described above is executed to all the fire detectors in the fire alarm equipment.

When the teaching to the definition table in FIG. 2 with respect to the network structure conceptually shown in FIG. 3, that is, the adjustment of the weighting values, has been completed, input values are applied to the network structure by a network calculation program to be described later to actually monitor an early stage fire, values obtainable from the output layer using the above equations 1 to 4 are determined by calculation and an early stage fire is discriminated by comparing the calculated values with reference values.

Operation of the embodiment of the present invention will be described below.

Figure 4:
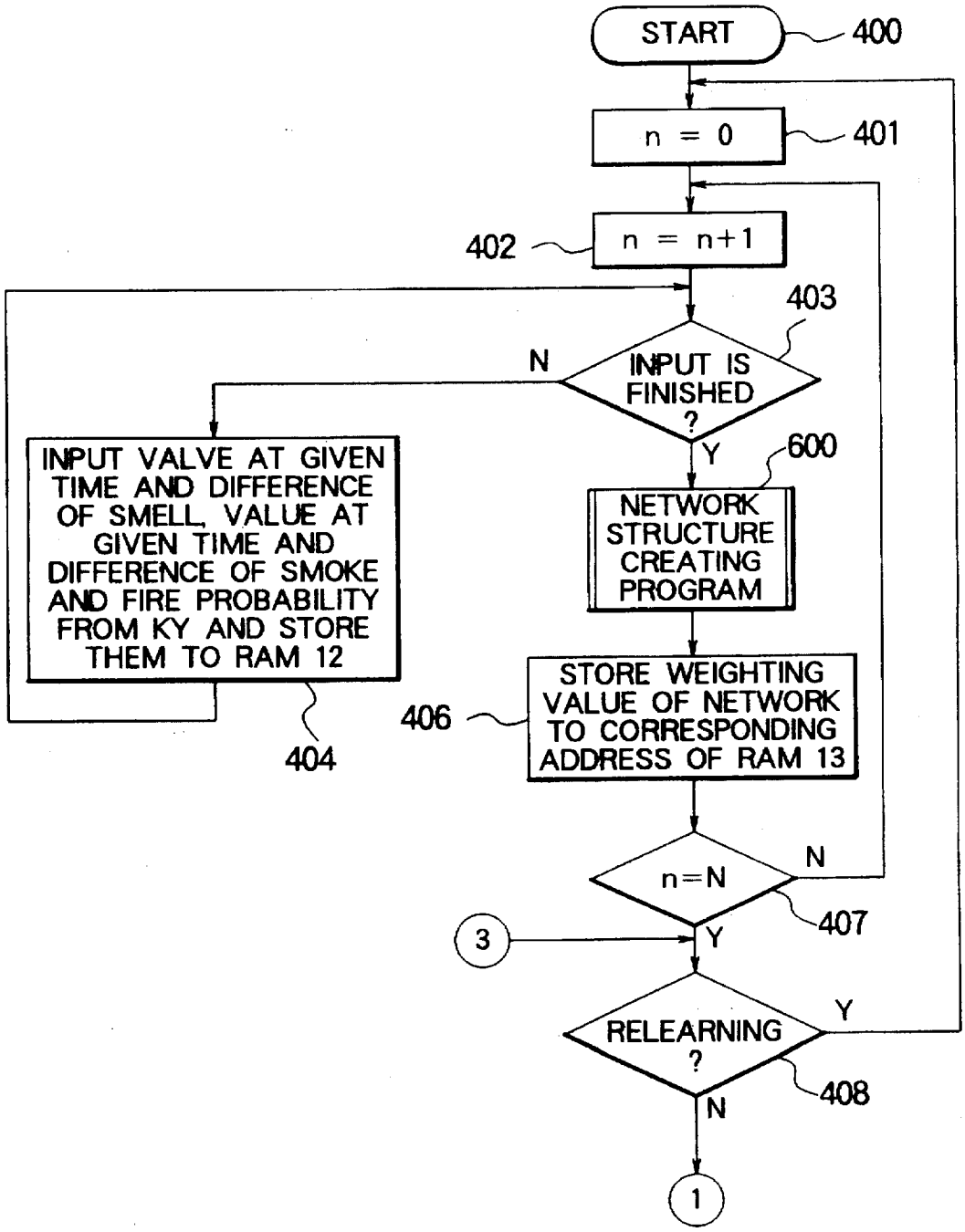
FIGS. 4 and 5 are flowcharts showing operation of the embodiment.

First, the network structure creating program is sequentially executed to each of N sets of the fire detectors from the first one thereof in FIG. 4. To describe operation of the network structure creating program in the n-th fire detector (n=1 to N), first, the value at a given moment and the difference of smell and the value at a given moment and the difference of smoke in the upper rows and the fire probabilities in the lowermost row of the definition table described in FIG. 2 are input from a learning data input key unit KY as a teacher's input or a learning input (step 404). The definition table is prepared for each fire detector because each fire detector is installed in a different environment and has different characteristics. When the same environmental conditions and characteristic conditions are employed, however, the same definition table can be used of course and when patterns of fire states and patterns of non-fire factors are sufficiently prepared in the definition table, the table can be commonly used for all the fire detectors.

Figure 6:
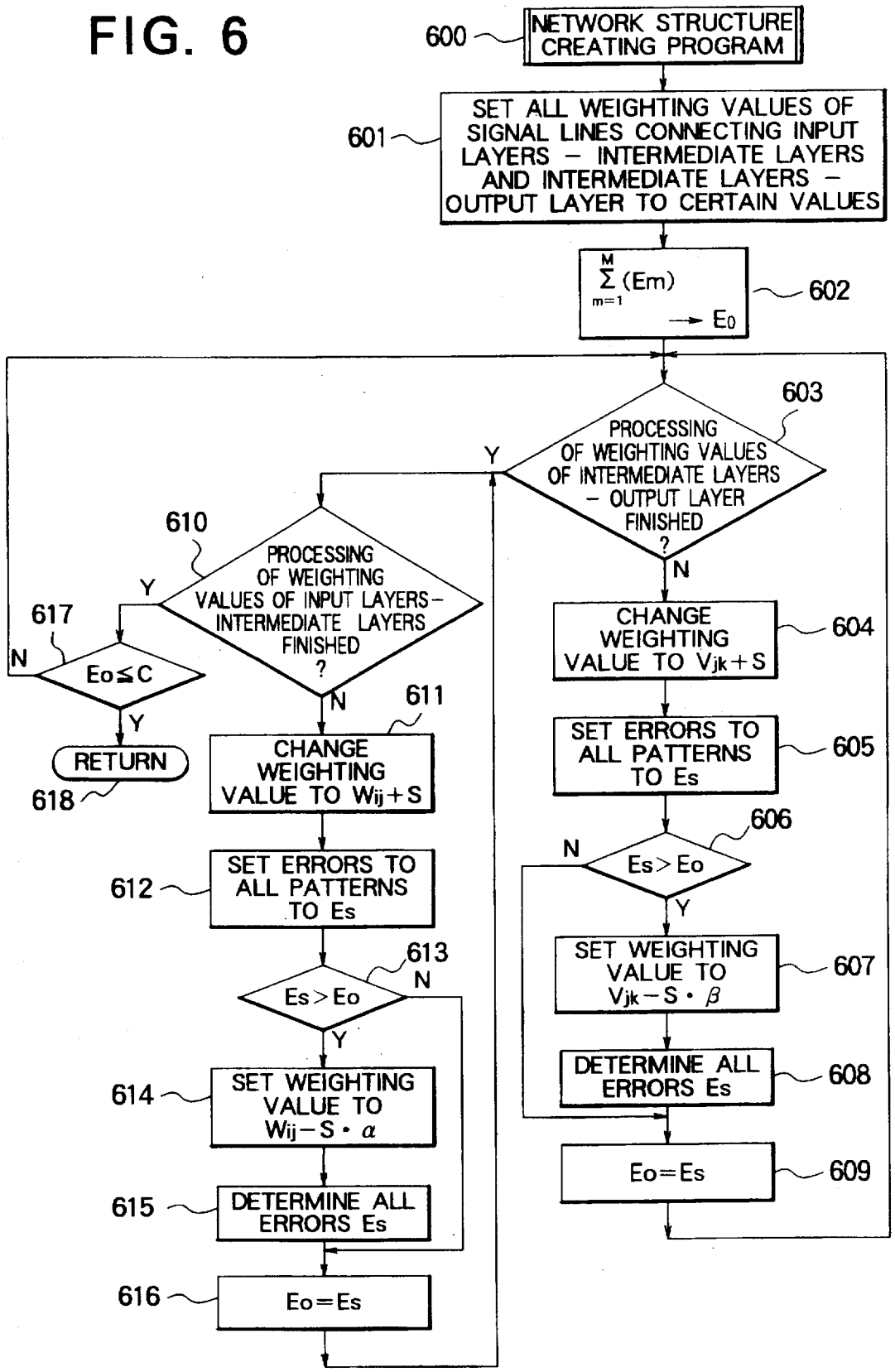
FIG. 6 is a flowchart showing a network structure creating program in the embodiment.

When the content of the definition table of the n-th fire detector is stored in the region of the n-th fire detector by the memory region RAM12 of the definition table from the key unit KY (step 403: YES), the process goes to the execution of the network structure creating program 600 shown in FIG. 6.

In the network structure creating program 600, first, the weighting values wij and vik of the 20 signal lines in total including the 16 signal lines between the input layers and the intermediate layers and the 4 signal lines between the intermediate layers and the output layer which are stored in the region of the n-th fire detector in the memory region RAM13 and described with reference to FIG. 3 are set to certain values (step 601). Next, the sum (E of the equation 6) of the squares of the errors between the actual outputs OT1 and the teacher's outputs T is determined with respect to all the M types of combinations (M=6) of the definition table of FIG. 2 according to the above equations 1 to 6 based on the weighting values set to the certain values and represented by E0 (step 602).

Next, the weighting value of each signal line between the intermediate layers and the output layer is first adjusted to minimize the sum E0 of the errors when inputs are applied to the same definition table (step 603: NO). Since only the weighting values between the intermediate layers and the output layer are adjusted, the values up to the above equations 1 and 2 are not changed. First, the weighting value v11 of the first signal line is changed to a weighting value v11+S (step 604) and the same calculations as those shown by the equations 3 to 6 are executed and the sum E of the final errors determined by the equation 6 is set to Es (step 605). Then, the sum Es is compared with the sum E0 of the errors prior to the change of the weighting values (step 606).

If Es≦E0 (step 606: NO), the value Es is set as a new value E0 (step 609) as well as the changed weighting value v11+S is stored to a suitable location of the job region.

If Es>E0 (step 606: YES), since the weighting value is changed in an erroneous direction, the weighting value is changed in an opposite direction with respect to the original weighting value v11 as a reference and the value E0 is calculated based on the equations 3 to 6 likewise using a weighting value v11−S·β (steps 607 and 608), the calculated value Es is set as a new value E0 (step 609) and the changed weighting value v11−S·β is stored to a suitable location in the job region. β is a coefficient proportional to |Es−E0|.

When the weighting value v11 has been changed and adjusted at steps 604–609, the weighting values v21–v41 of the remaining signal lines are sequentially changed and adjusted in the same way. When the weighting values vjk of all the signal lines between the intermediate layers and the output layer have been adjusted (step 603: YES) as described above, next, the weighting values wij of the signal lines between the input layers and the intermediate layers are adjusted based on all the equations 1 to 6 at steps 610 to 616 to minimize errors in the same way.

When the weighting values wij and vjk of all the signal lines have been adjusted (step 610: YES), the value E0 having been reduced as described above is compared with a predetermined allowable value C. If the value E0 is still larger than the allowable value C (step 617: NO), the process returns to step 603 to further reduce errors and the above processing is repeated from the adjustment of the weighting values vjk between the intermediate layers and the output layer executed at steps 604 to 609. When the value EO is made to a value equal to or less than the allowable value C by the repeated adjustment (step 617: YES), the process goes to step 406 shown in FIG. 4 to store the respective changed and adjusted weighting values wij and vjk of the 20 signal lines to the corresponding addresses of the region of the n-th fire detector in the memory region RAM13, respectively.

In the above operation, the values S, α, β, C and the like are stored in the memory region ROM12 of various constant value tables.

Note, since the final error of the value Es cannot be made to zero, the adjustment of the weighting values of the signal lines are suitably finished. That is, the adjustment may be finished when the value Es is made to a value equal to or less than the allowable value C as shown at step 617 or may be automatically finished when the weighting values are adjusted to the preset number of times.

FIG. 8 shows an example of fire probabilities obtained in such a manner that the network structure of FIG. 3 is created by repeating the adjustment at steps 603 to 616 and fire information is input to the thus created network structure. Respective patterns A–F are the same as the patterns A–F of the definition table of FIG. 2 and the fires probabilities OT1 are shown in the lowermost column of FIG. 8. As described above, optimum fire probabilities can be obtained by defining the four types of fire information as six patterns even if there is no pattern of combination in the fire information. Note, FIG. 9 shows respective weighting values when the result shown in FIG. 8 is obtained.

Although the present invention shows the case that the network structure has the four inputs and the one output, it is possible to increase or decrease the number of inputs relating to the smell sensor and high sensitivity smoke sensor corresponding to the detecting of an early stage fire and to increase the number of outputs by classifying information to be obtained. For example, values obtained by integrating detecting levels detected by respective sensors for a predetermined period of time and outputs from the same type of sensors each having different characteristics may be used as the input and non-fire probabilities due to tobacco and degrees of danger and the like may be used as the output. Further, the area of a region to be monitored and the height of the ceiling of the area, the presence or absence of ventilation, the presence or absence of persons and the like may be used as indirect data although they are not the information of physical values directly based on an early stage fire.

Figure 5:
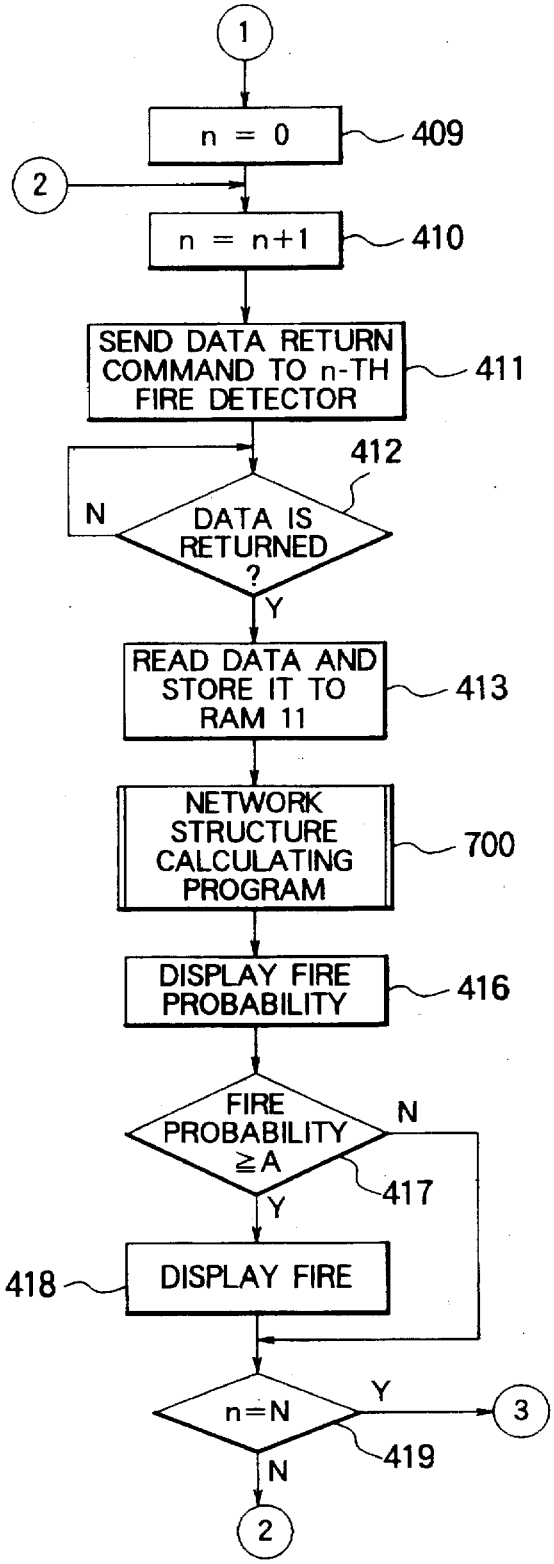

When the weighting values of the respective signals of the network structure has been adjusted with respect to all the N sets of the fire detectors (step 407: YES) and it is determined that re-learning is not necessary (step 408: NO), fire monitoring operation is sequentially carried out from the first fire detector as shown in a flowchart of FIG. 5.

To describe the early stage fire monitoring operation to the n-th fire detector DEn, when the fire detector DEn receives a data return command supplied from the fire receiver RE from the signal transmitting/receiving unit TRX2 through the interface IF23 (step 411), the n-th fire detector DEn causes the smell sensor NS and smoke sensor SS to fetch detecting levels detected by separate voltages or the like through the interfaces IF21 and IF22 based on the program stored in the memory region ROM21, respectively, applies the address of the n-th fire detector DEn set in the memory region ROM22 to the value at a given moment and the difference of smell and the value at a given moment and the difference of smoke as fire information standardized based on the data in the memory regions ROM23 and ROM24, respectively and returns the data to the fire receiver RE from the signal transmitting/receiving unit through the interface 23.

Figure 7:
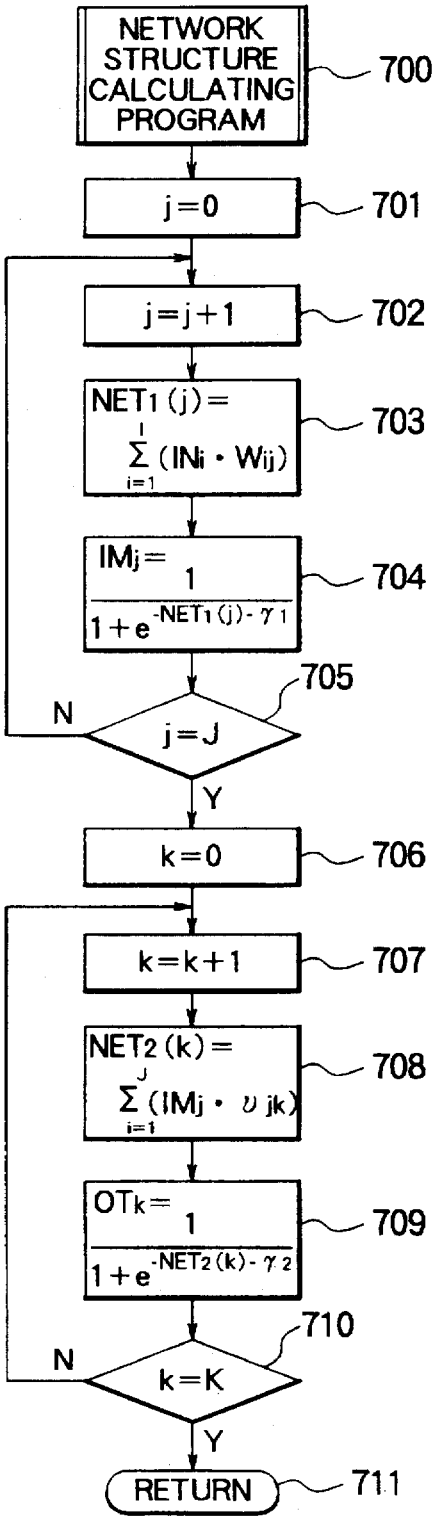
FIG. 7 is a flowchart showing a network structure calculating program in the embodiment.

On receiving the fire information returned from the nth fire detector (step 412: YES), the fire receiver RE stores the fire information to the job memory region RAM11 (step 413). Then, the network structure calculating program 700 shown in FIG. 7 is executed.

NET1(j) is calculated according to the above equation 1 in the network structure calculating program 700 (step 703) and converted into a value IMj according to the above equation 2 (step 704). When all the values from IM1 to IM4 are determined (step 705: YES), NET2(k) is calculated using the value IMj according to the above equation 3 (step 708) and converted into a value OTk according to the equation 4 (step 709). The value OTk, i.e., the value OT1 represents a fire probability.

Then, the value OT1 is displayed as it is as the fire probability (step 416) and also compared with the reference value A of fire probability read out from the memory region ROM12 (step 417). If OT1≧A, a fire indication is displayed (step 418). Although not shown in the flowchart, a reference value for a preliminary warning is set to a value smaller than the above reference value A in the same way as the reference value A to discriminate the preliminary warning. Further, the discrimination of the preliminary warning is executed at two steps and a first preliminary warning is issued to a location far from a fire and a second preliminary warning is issued to a location near to the fire. Since it is contemplated that the detection of an early stage fire is more difficult than the detection of a usual fire as described above, when there is a possibility that an early stage fire occurs, it is more reliable to check the fire by a person such as a guardsman.

The early stage fire monitoring operation of the n-th fire detector is completed by the aforesaid steps and the same early stage fire monitoring operation is carried out to the next fire detector in the same way.

Note, although data is artificially input to the memory region RAM12 of the definition table and the weighting values are stored in the memory region RAM13 by the network structure creating program based on the data, it is also possible that the weighting values are determined using the network structure creating program in a manufacturing step of a factory and the like and stored in a ROM such as an EEPROM or the like and the content of the ROM is read out for use.

Further, the present invention is also applicable to an on/off type fire alarm system in which a fire is discriminated by respective fire detectors and only the result of discrimination is supplied to receiving means such as a fire receiver, a transmitter and the like in place of the analog type fire alarm equipment of the above embodiment. In this case, the memory regions ROM11 and ROM12 shown on the fire receiver RE side in FIG. 1 are transferred to the respective fire detectors DEn side. Although the memory regions RAM12 and RAM13 may be transferred, it is more advantageous to provide a ROM to which weighting values are stored at a manufacturing step in a factory and the like with each fire detector than to transfer them.

As described above, according to the present invention, since a fire is detected by a signal processing network (neural network) using the smell sensor and smoke sensor from which responses can be obtained in an early stage of fire, an early stage fire can be securely detected by explicitly excluding non-fire factors such as the smoke of tobacco, steam vapor and the like and the smell of coffee and the like which will be otherwise detected by the smoke sensor and smell sensor. Since the accuracy of the signal processing network can be improved by learning, the unacceptable portion of an original definition table due to unexpected non-fire factors can be easily corrected.

What is claimed is:

1. An early stage fire detecting apparatus, comprising:

a high sensitivity smoke sensor for detecting a concentration of smoke;

a smell sensor for detecting smell;

input means for subjecting output values from said high sensitivity smoke sensor and said smell sensor to signal processing and obtaining four types of input data composed of a value representing the concentration of smoke at a given moment, a value representing an amount of change in the concentration of smoke over time, a value representing the level of smell at a given moment, and a value representing an amount of change in the level of smell over time;

a signal processing network for calculating a fire probability based on the values of the four types of input data obtained from said input means; and fire discriminating means for discriminating a fire state based on the fire probability calculated by said signal processing network.

2. An early stage fire detecting apparatus according to claim 1 further comprising:

a memory for storing a table which defines a reference fire probability obtainable for each of a plurality of preset patterns, including a preset non-fire pattern, composed of a combination of values of the four types of input data, said signal processing network having a weighting value for each of the input data so that the reference fire probability defined in the table is obtained when the input data of each preset pattern is input and stored in said memory and the reference fire probability is calculated from the input data using the weighting value.

3. An early stage fire detecting apparatus according to claim 2 wherein said signal processing network includes:

input layers to which the four types of input data are input from said input means;

intermediate layers for obtaining four types of intermediate data by weighting and adding the four types of input data input to said input layers, respectively; and an output layer for obtaining the fire probability by weighting and adding the four types of intermediate data from said intermediate layers.

4. An early stage fire detecting apparatus according to claim 3 wherein signal lines connect each input layer to each intermediate layer, signal lines connect each intermediate layer to said output layer, and said signal processing network has a weighting value of each signal line between said input layers and said intermediate layers and a weighting value of each signal line between said intermediate layers and said output layer to minimize an error between the value of a fire probability obtained in said output layer when the input data of each preset pattern of the table stored in the said memory is input to said input layers and the value of said reference fire probability defined by the table.

5. An early stage fire detecting apparatus according to claim 1 wherein said high sensitivity smoke sensor is a light scattering type smoke sensor.

6. An early stage fire detecting apparatus according to claim 1 wherein said smell sensor detects scorching smell by a stannic oxide thin film element.

7. An early stage for detecting apparatus according to claim 1 wherein said smell sensor detects fire factor smells and non-fire factor smells.

8. An early stage fire detecting apparatus, comprising:

at least one fire sensor including a smoke sensor for detecting smoke, a smell sensor for detecting smell, and a signal processor for receiving detections from said smoke sensor and said smell sensor and for obtaining a first value of a level of smoke at a given moment, a second value of an amount of change in the level of smoke over time, a third value of a level of smell, and a fourth value of an amount of change in the level of smell over time;

a fire receiver for receiving said first, second, third and fourth values from said fire sensor through a means for transmitting, said fire receiver including, a signal processing network for calculating a fire probability based on said first, second, third and fourth values transmitted from said fire sensor, and fire discriminating means for discriminating a fire state based on the fire probability calculated by said signal processing network.

9. An early stage fire detecting apparatus according to claim 8 wherein said smoke sensor comprises a high sensitivity smoke sensor for detecting a concentration of smoke.

10. An early stage fire detecting apparatus according to claim 9 wherein said high sensitivity smoke sensor comprises a light scattering type smoke sensor.

11. An early stage fire detecting apparatus according to claim 8 wherein said smell sensor comprises a stannic oxide thin film element for detecting a scorching smell.

12. An early stage for detecting apparatus according to claim 8 wherein said smell sensor detects fire factor smells and non-fire factor smells.

* * * * *